US009506188B2

(12) United States Patent
Pourladian et al.

(10) Patent No.: US 9,506,188 B2
(45) Date of Patent: Nov. 29, 2016

(54) TORQUE BALANCED HYBRID ROPE

(71) Applicant: WireCo WorldGroup Inc., Kansas City, MO (US)

(72) Inventors: Bamdad Pourladian, Kansas City, KS (US); Gregory John D'Elia, Hatboro, PA (US)

(73) Assignee: WIRECO WORLDGROUP, INC., Prairie Village, KS (US)

( * ) Notice: Subject to any disclaimer, the term of this patent is extended or adjusted under 35 U.S.C. 154(b) by 0 days.

(21) Appl. No.: 14/211,237

(22) Filed: Mar. 14, 2014

(65) Prior Publication Data

US 2014/0260175 A1 Sep. 18, 2014

Related U.S. Application Data

(60) Provisional application No. 61/785,823, filed on Mar. 14, 2013.

(51) Int. Cl.

| | |
|---|---|
| ***D07B 1/06*** | (2006.01) |
| ***D07B 1/00*** | (2006.01) |
| ***D07B 5/00*** | (2006.01) |

(Continued)

(52) U.S. Cl.

CPC ..... *D07B 1/0686* (2013.01); *D07B 1/005* (2013.01); *D07B 1/141* (2013.01); *D07B 5/007* (2013.01); *D07B 1/08* (2013.01); *D07B 2201/1064* (2013.01); *D07B 2201/2002* (2013.01); *D07B 2201/2019* (2013.01); *D07B 2201/2074* (2013.01); *D07B 2205/205* (2013.01); *D07B 2205/2014* (2013.01);

(Continued)

(58) Field of Classification Search

CPC .... D07B 1/005; D07B 1/0686; D07B 1/141; D07B 1/144; D07B 5/007

USPC ..... 57/222, 237, 238

See application file for complete search history.

(56) References Cited

U.S. PATENT DOCUMENTS 2,018,230 A * 10/1935 Robertson ..... 57/222
3,092,956 A 6/1963 Naysmith (Continued)

FOREIGN PATENT DOCUMENTS

GB 1391355 4/1975

OTHER PUBLICATIONS

Timothy W. Klein, The Changing Culture of Wire Ropes for Vertical Lift Bridges, Heavy Movable Structures, Inc. Thirteenth Biennial Symposium, Oct. 25-28, 2010, 10 pages.

*Primary Examiner* — Shaun R Hurley
(74) *Attorney, Agent, or Firm* — Husch Blackwell LLP

(57) ABSTRACT

A hybrid rope constructed of a plurality of strands, wherein each strand is constructed of a fiber center, a jacket surrounding the fiber center, and a plurality of wires surrounding the jacket. The fiber center can be constructed of one or more high-strength synthetic fibers or yarns. The jacket can be constructed of polypropylene, thermoplastic polyurethane, high-density polyethylene, linear low-density polyethylene, nylon or other similar materials. The jacket can have a braided or woven design and adds a protective layer between the fiber center and the wires. The wires can be constructed of high-strength steel wires, galvanized steel or stainless steel. The fibers or yarns that make of the fiber center are twisted to lay right and then covered with the jacket. The wires then surround the jacket and are twisted to lay to the left. This creates a torque-balanced condition of the hybrid rope.

20 Claims, 5 Drawing Sheets

(51) Int. Cl.
*D07B 1/14* (2006.01)
*D07B 1/08* (2006.01)

(52) U.S. Cl.
CPC ..... *D07B 2205/2042* (2013.01); *D07B 2205/2096* (2013.01); *D07B 2401/2015* (2013.01)

(56) References Cited

U.S. PATENT DOCUMENTS 3,374,619 A 3/1968 Adams et al.
3,686,855 A * 8/1972 Falcy et al. ..... 57/220
3,705,489 A 12/1972 Smollinger
4,106,276 A 8/1978 Hosoya
4,321,854 A 3/1982 Foote et al.
4,365,467 A 12/1982 Pellow
4,807,680 A * 2/1989 Weidenhaupt ..... D02G 3/48 152/451
4,878,343 A * 11/1989 Weidenhaupt ..... D02G 3/48 152/451
4,887,422 A 12/1989 Klees et al.
5,797,254 A * 8/1998 Walton ..... 57/220
6,334,293 B1 1/2002 Poethke et al.
6,412,264 B1 * 7/2002 De Josez et al. ..... 57/217
6,563,054 B1 * 5/2003 Damien et al. ..... 174/120 C
8,079,208 B2 * 12/2011 Volpi ..... 57/222
8,176,718 B2 5/2012 Ridge et al.
8,438,826 B2 * 5/2013 Pourladian et al. ..... 57/237
2010/0162882 A1 * 7/2010 Shakespeare ..... 87/6
2012/0085077 A1 4/2012 Pourladian et al.
2012/0159919 A1 * 6/2012 Gauthier et al. ..... 57/212

* cited by examiner

TORQUE BALANCED HYBRID ROPE

CROSS-REFERENCE TO RELATED APPLICATIONS

This Application claims priority to U.S. Provisional Patent Application Ser. No. 61/785,823, filed on Mar. 14, 2013, entitled "Torque Balanced Hybrid Rope,", the entire disclosure of which is incorporated herein by reference.

BACKGROUND OF THE INVENTION

High-strength ropes are used for many commercial and recreational purposes; many of which require long continuous lengths to perform the desired function. For example, applications such as deep sea moorings, deep shaft hoisting, deep-sea winching, tower cranes, aerial lifting or hoisting, and other applications. Many of these applications require a substantial length of rope to perform its function, and the self-weight of the rope may become excessive and hinder the ability to perform the desired function. Moreover, because many of these applications involve hoisting or lifting objects, it is desirable for these ropes to be torque-balanced; that is, the configuration of the lay of the individual wires comprising the rope strands and the twist of the rope strands in order to form the rope are substantially balanced such that the rope inherently resists rotating when a tension force is applied.

If the rope is not torque-balanced, the item being hoisted or lifted will just rotate in a circle which may introduce imbalance or other undesirable forces or movements. Many of the commercial applications utilize wire rope because it provides a high strength and sufficient ductility thereby allowing for a gradual and visual indication of failure or damage prior to actual failure. The ability to detect potential failures using non-destructive testing is paramount for many of these applications as it allows rope defects to be observed by operators and inspectors prior to the occurrence of an actual failure and thereby prevent accidents.

One persistent shortcoming in the art is that the weight of wire rope limits many applications because the wire rope itself weighs so much that it significantly works against the desired functionality of the application utilizing wire rope. One option available is to reduce the weight of the rope by using lighter-weight, high-strength synthetic fiber ropes. High-strength synthetic fiber ropes provide a desirable strength-to-weight ratio and may also be torque-balanced or rotation resistant. However, in any running rope applications wherein the rope has to be spooled on a multilayer drum or winch, synthetic ropes tend to perform poorly. Synthetic fiber ropes often fail in running rope applications because they lack the abrasion resistance and durability necessary. Further, synthetic fiber rope tends to flatten when it is wound under tension and thus, it is not ideal for multi-layer spooling applications. The continual abrasion and flattening out of wire rope when it is spooled on a drum or winch gradually breaks down the fibers thereby gradually reducing the strength of the rope. This reduction in strength is usually not detectable using non-destructive testing thereby leaving the condition of the rope unknown at any given time. If the actual strength of the rope decreases to a point that it is lower than the working stress required for the application, then a sudden failure may occur. Since the working stress is experienced when the rope is hoisting or otherwise being tensioned, a sudden failure of the wire rope would only occur when it is loaded and would put workers at risk and/or cause damage to the equipment being hoisted and surrounding property, or potentially many other undesirable and/or dangerous conditions.

There is a substantial need in the art for a reduced-weight torque-balanced rope that (i) provides the strength-to-weight ratio of high-strength synthetic rope, (ii) provides the tensile strength provided by wire rope or high-strength synthetic rope, (iii) is cut and abrasion resistant, and (iv) has the desired durability of wire rope for rope or tension members that are used in running-rope or other applications.

SUMMARY

One embodiment of present invention is directed to a reduced-weight torque-balanced rope that (i) provides the strength-to-weight ratio of high-strength synthetic rope, (ii) provides the tensile strength provided by wire rope or high-strength synthetic rope, (iii) is cut and abrasion resistant, and (iv) has the desired durability of wire rope for rope or tension members that are used in running-rope or other applications.

The rope is a hybrid rope constructed of both fiber and wires. A plurality of strands are twisted and then compacted together to construct the hybrid rope. Each strand can be constructed of a fiber center, a jacket surrounding the fiber center, and a plurality of wires surrounding the jacket. The fiber center can be constructed of one or more high-strength synthetic fibers or yarns. The jacket can be constructed of polypropylene, thermoplastic polyurethane, high-density polyethylene, linear low-density polyethylene, nylon or other similar materials. The jacket can have a braided or woven design and adds a protective layer between the fiber center and the wires. The wires can be constructed of high-strength steel wires, galvanized steel or stainless steel.

The fibers or yarns that make of the fiber center are twisted to lay right and then covered with the jacket. The wires then surround the jacket and are twisted to lay to the left. This creates a torque-balanced condition of the hybrid rope.

Other aspects and advantages of the present invention will be apparent from the following detailed description of the preferred embodiments and the accompanying drawing figures.

BRIEF DESCRIPTION OF THE SEVERAL VIEWS OF THE DRAWING

The accompanying drawings form a part of the specification and are to be read in conjunction therewith, in which like reference numerals are employed to indicate like or similar parts in the various views, and wherein.

DETAILED DESCRIPTION OF THE INVENTION

Figure 1:
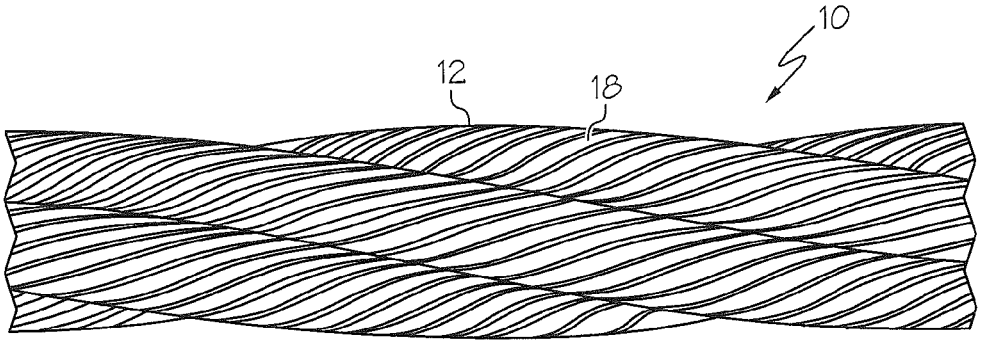
FIG. 1 is a side view of one embodiment of a hybrid rope in accordance with the teachings of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

Figure 5:
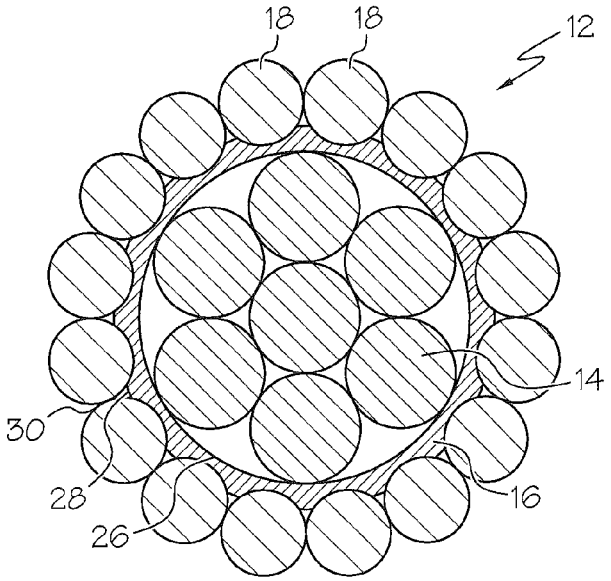
FIG. 5 is a cross-sectional view of one embodiment of a single strand of the hybrid rope of FIG. 1 in accordance with the teachings of the present invention.

A hybrid rope 10 embodying various features of the present invention is shown in FIG. 1. As illustrated in FIG. 1, the present invention is directed toward hybrid rope 10 comprising a plurality of strands 12 twisted together. As shown in FIG. 5, each strand 12 comprises a fiber center 14, a jacket 16 surrounding fiber center 14, and a plurality of wires 18 surrounding jacket 16.

Figure 2:
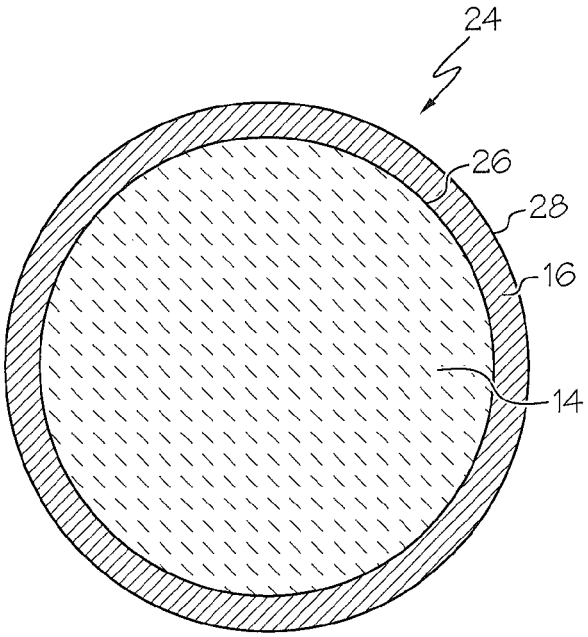
FIG. 2 is a cross-sectional view of one embodiment of a jacketed fiber center of the hybrid rope of FIG. 1 in accordance with the teachings of the present invention.
Figure 3:
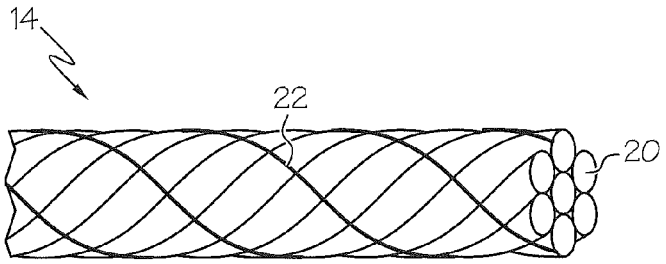
FIG. 3 is a side view of one embodiment of a fiber center of the hybrid rope of FIG. 1 in accordance with the teachings of the present invention.

As shown in FIG. 2, fiber center 14 is surrounded by jacket 16. As shown in FIG. 3, one embodiment of fiber center 14 comprises a plurality of fiber strands 20. One embodiment includes fiber center 14 having seven fiber strands 20, though any number of fiber strands 20 may be used. For example, an embodiment of fiber center 14 may be comprised of four to twelve (4-12) fiber strands 20 twisted at a particular angle and fiber strands 20 may be one of various known diameters, including from about 0.159 inches to 0.370 inches in diameter. Fiber strands 20 are comprised of one or a combination of high-strength synthetic fibers or yarns. In one embodiment, each fiber strand 20 is made up of eleven (11) yarns where each yarn is made up of a plurality of fibers. Any high-strength or high modulus fibers may be used including: aramid fibers, such as Kevlar® made by E.I. du Pont de Nemours and Company, Twaron® made by Teijin Aramid, or Technora® made by Teij in Aramid; liquid-crystal polymer fibers, such as Vectran® made by Kuraray Co. Ltd.; ultra-high molecular weight polyethylene; poly(p-phenylene-2,6-benzobisoxazole) fibers, such as Zylon® made by Toyobo Corporation; or any other high strength or high modulus fiber now known or hereafter developed.

One embodiment of fiber center 14 includes having a plurality of fiber strands 20 twisted at a lay angle in a range between about one and about thirty degrees (1°-30°). One embodiment includes fiber strands 20 having a lay angle of about two degrees (2°). Another embodiment includes fiber strands 20 having a lay angle of about twelve and one-half degrees (12.5°). Fiber strands 20 may be configured to lay to the right or to the left. The entirety of hybrid rope 10 can have a size from about 6 mm to about 76 mm in diameter.

As further shown in FIG. 3, fiber center 14 may include a binder that lays opposite fiber strands 20 as shown. Binder 22 is configured to hold the fiber strands 20 from unwrapping. Fiber center 14 can have the configuration as shown in FIG. 5. Alternatively, tape (not shown) could be used instead of fibers for binder 22 or the yarns of fiber center 14. The tape may be made of, but is not limited to, Teflon® made by E.I. du Pont de Nemours and Company, Kevlar® made by E.I. du Pont de Nemours and Company, UHMPE, Endumax® made by Teijin Aramid, or ePTFE. The tape may be used in addition to or instead of a braided jacket.

Figure 4:
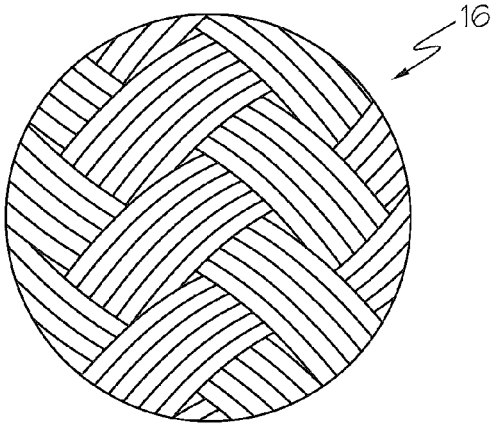
FIG. 4 is a sectional view of one embodiment of a braided jacket in accordance with the teachings of the present invention.

As shown if FIG. 2, jacket 16 includes an inner surface 26 and an outer surface 28 that defines a material thickness. Jacket 16 surrounds fiber center 14 substantially along the entire length of fiber center 14 creating a jacketed fiber 24 center. Jacket 16 can be polypropylene, thermoplastic polyurethane, high-density polyethylene, linear low-density polyethylene, nylon, or other like materials. As shown in FIG. 4, jacket 16 can have a braided or woven design. Jacket 16 adds a protective layer between fiber center 14 and wires 18.

As shown in FIG. 5, each strand 12 has a plurality of wires 18 wrapped around core 14. As shown in FIG. 5, wires 18 may deform into and create an indentation 30 in a portion of outer surface 28 of jacket 16 thereby seating wires 18 in jacket 16. One embodiment includes sixteen (16) wires 18 wrapped around jacketed fiber center 24. However, any number of wires 18 may be used. Wires 18 provide strength and abrasion resistance when combined with jacketed fiber center 24. Another embodiment includes wires 18 having a diameter from about 0.03 inches to 0.15 inches. However, any wire diameter known in the art is within the scope of the present invention. The diameter of each wire 18 and the outer diameter of the jacketed fiber center 24 will necessarily determine the number of wires 18 utilized in hybrid rope 10 of the present invention and the out-to-out dimension of hybrid rope 10. Wires 18 are generally high-strength steel wires having an ultimate tensile strength in a range between about one thousand seven hundred (1700) MPa and about two thousand seven hundred (2700) MPa. Wires 18 may also be galvanized or stainless steel, or any metal or alloy that provides desired traits for the environment in which hybrid rope 10 is to be used.

FIG. 1 shows an embodiment of hybrid rope 10 wherein wires 18 of strand 12 are wrapped around jacketed fiber center 24 in a lay left configuration. Further, as shown in FIG. 1, strands 12 are twisted to lay right. The opposing lay of the twist of strands 12 and the lay of wires 18 contribute to the torque-balancing or rotation-resistance of hybrid rope 10. As such, the lay of wires 18 wrapped around fiber center 14 will generally be the opposite of the lay of the strands 20 twisted into hybrid rope 10. Although this is a common lay configuration, strands 12 can be twisted to lay left. Moreover, the helix angle at which both fiber strands 20 of fiber center 14, wires 18 and strands 12 are wrapped contribute to the rotational properties of hybrid rope 10. Wires 18 and strands 12 may be wrapped at any helix angle now known and more preferably at 12.5 degrees. Accordingly, the helix angle for each strand 12 and 20, and wire 18 may be optimized together to provide the optimal torque-balanced condition. The lay direction and helix angle of fiber strands 20 in fiber center 14 also contribute to the optimal torque-balance.

Figure 6:
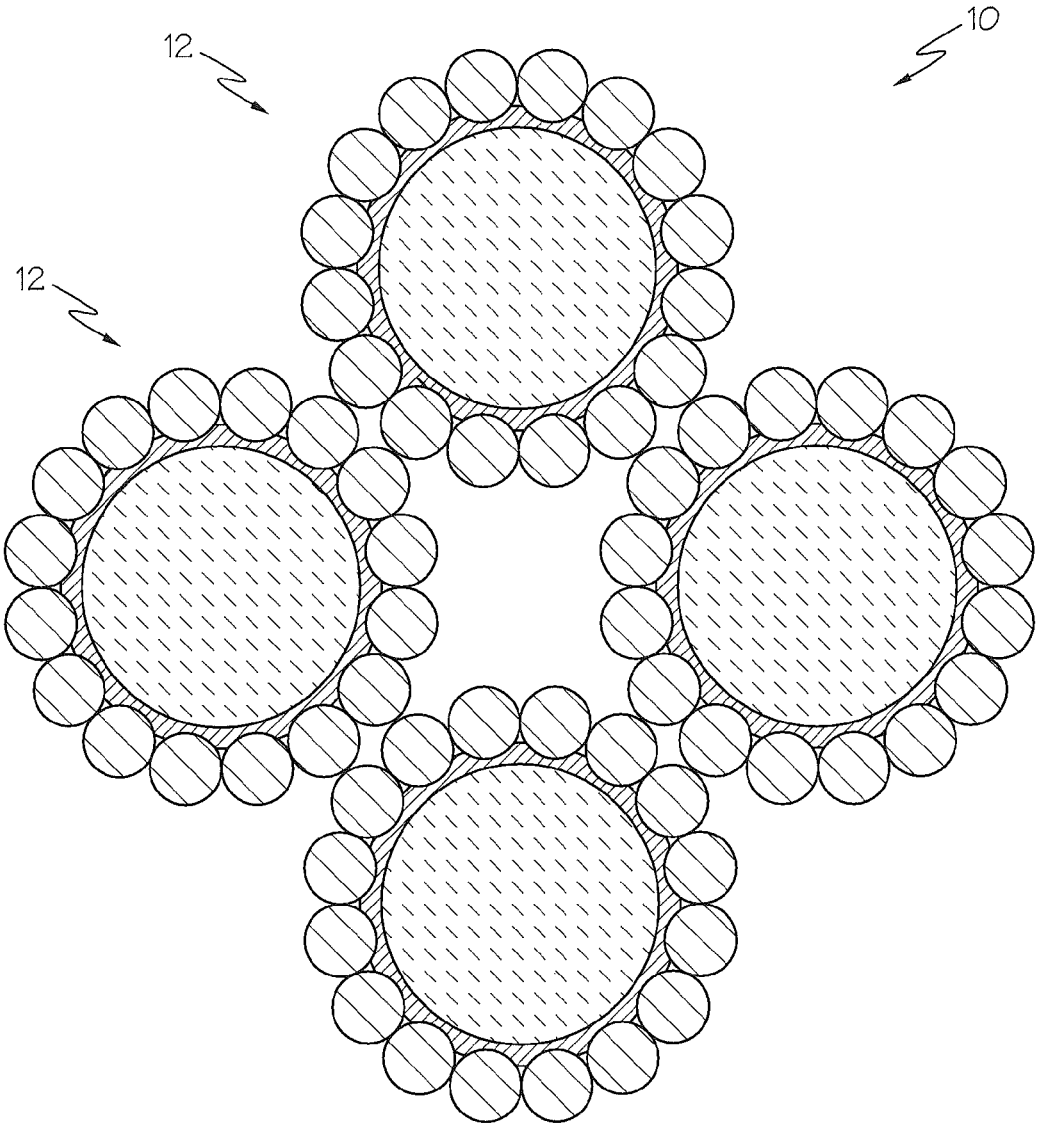
FIG. 6 is a cross-sectional view of one embodiment of four strands used to construct the hybrid rope of FIG. 1 in accordance with the teachings of the present invention.
Figure 7:
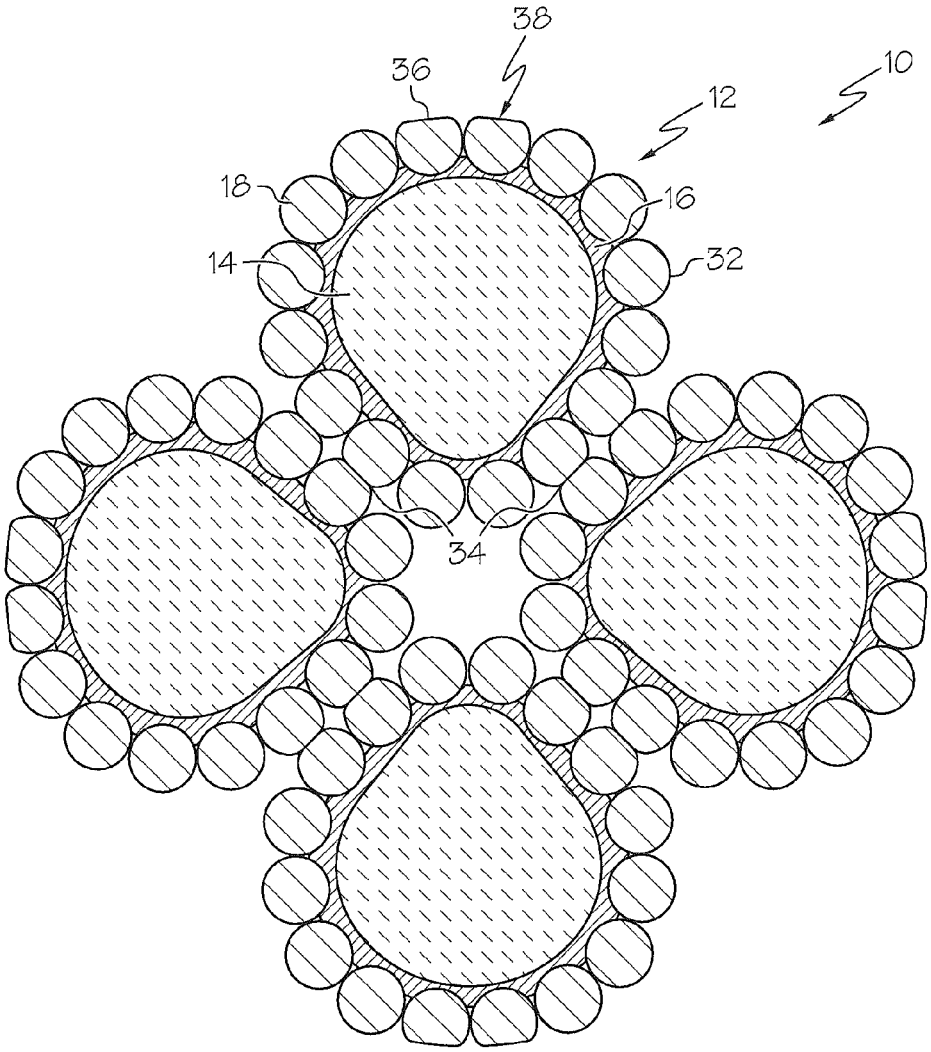
FIG. 7 is a cross-sectional view of one embodiment of the four strands of FIG. 6 after compaction in accordance with the teachings of the present invention.

Referring to FIG. 6, illustrates hybrid rope 10 having four strands 12 and having a closed spiral (or helical) arrangement. Hybrid rope 10 is torque-balanced as described hereinabove. Referring to FIG. 7, one embodiment of hybrid rope 10 may be compacted as a final manufacturing step after strands 12 are closed and helically arranged to form hybrid rope 10. Hybrid rope 10 is compacted resulting in each substantially circular strand 12 (as shown in FIG. 6) having a "triangular" shape wherein the outer surface 32 of strands 12 include a flattened portion 34 wherein a strand 12 engages another strand 12 (as shown in FIG. 7). Compaction can include swaying or roller die compaction methods. Further, wires 18 may also include another flattened portion 36 and wherein the outer surface 38 of hybrid rope 10. The compacting of hybrid rope 10 allows it to have a substantially uniform outer surface 38 that facilitates wrapping of hybrid rope 10 on spools or other wrapping device and may further contribute to hybrid rope 10 not "flattening out" during spooling under tension.

The embodiment of hybrid rope 10 shown in FIGS. 1 through 7 is configured to provide substantially the same tension load capacity as currently used for 3×19 rope for similar applications. As such, the outer diameter of hybrid rope 10 will be substantially equal to the diameter of the 3×19 rope currently known in the art. However, an embodiment hybrid rope 10 is configured to provide a thirty percent (30%) or more reduction in rope weight than standard 3×19 torque balanced wire rope. This embodiment substantially matches the out-to-out dimensions of standard 3×19 wire rope known in the art.

Figure 8:
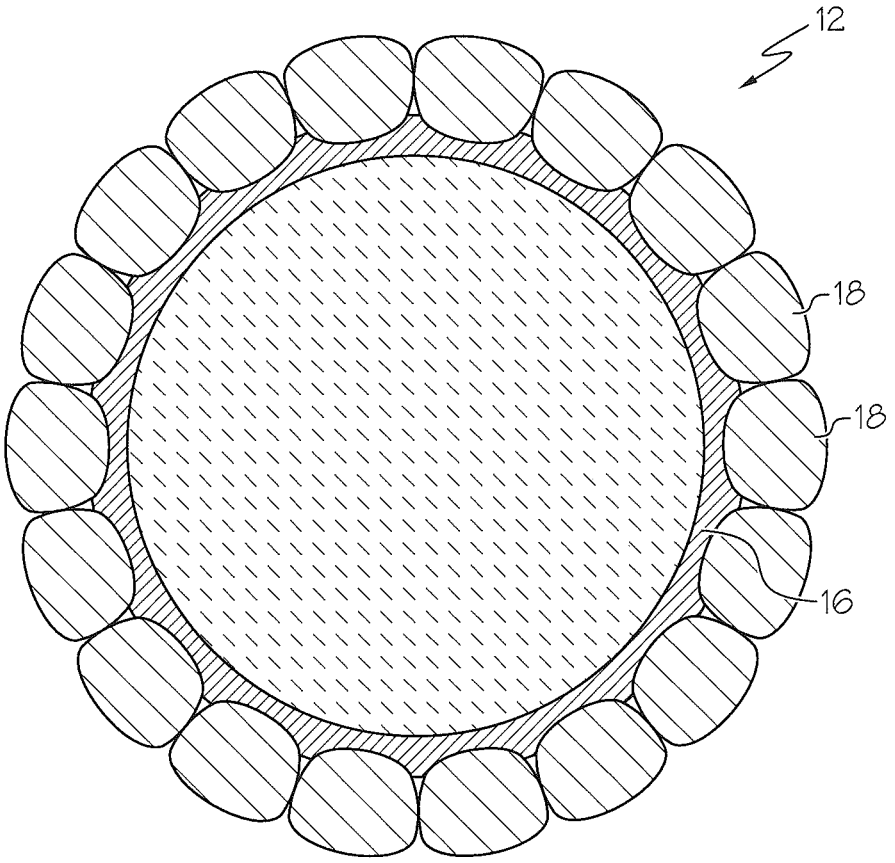
FIG. 8 is a cross-sectional view of one embodiment of a single strand of a hybrid rope in accordance with the teachings of the present invention.

FIG. 8 illustrates an embodiment where wires 18 have a substantially "D" shaped cross-section wherein the "curved side" is in contact with jacket 16 as shown. Alternatively, the wires can have a variety of shapes, including a "z" shape.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A torque balanced hybrid rope comprising:

a plurality of strands having a closed spiral arrangement with each other, wherein each said strand includes a fiber center comprising a plurality of fibers spirally arranged with a helical angle of approximately between 2 and 12.5 degrees and surrounded by a plurality of wires spirally arranged in the same direction as said plurality of fibers around said fiber center, and wherein said plurality of strands is twisted in an opposite direction as said plurality of fibers and said plurality of wires so that said hybrid rope resists rotating when a tension force is applied to the rope in a lifting operation.

2. The hybrid rope of claim 1 further comprising a jacket surrounding said fiber center.

3. The hybrid rope of claim 2 wherein said jacket is braided over said fiber center.

4. The hybrid rope of claim 3 wherein said jacket is made of one of polypropylene, thermoplastic polyurethane, high-density polyethylene, linear low-density polyethylene, or nylon.

5. The hybrid rope of claim 1 wherein said plurality of wires fibers is spirally arranged with a helical angle of approximately 12.5.

6. The hybrid rope of claim 1 wherein said plurality of fibers is made of one of aramid fibers, liquid-crystal polymer fibers, ultra high molecular weight polyethylene fibers, poly(p-phenylene-2,6-benzobisoxazole) fibers, or high modulus fibers.

7. The hybrid rope of claim 6 wherein said plurality of fibers is seven.

8. The hybrid rope of claim 1 wherein said plurality of wires is sixteen.

9. The hybrid rope of claim 1 wherein said plurality of strands is four.

10. The hybrid rope of claim 1 further comprising a lubricant applied to said fiber center prior to said fiber center being jacketed.

11. The hybrid rope of claim 1 wherein said hybrid rope is compacted by a swaging or roller die compaction process.

12. The hybrid rope of claim 1 wherein said a plurality of fibers is spirally arranged to the left and said plurality of wires is spirally arranged to the left around said plurality of fibers and wherein said hybrid rope is twisted to the right.

13. A torque balanced hybrid rope comprising:

a plurality of strands having a closed spiral arrangement with each other, wherein each said strand includes a fiber center made up of a plurality of fibers spirally arranged to the left with a helical angle of approximately between 2 and 12.5 degrees, a jacket surrounding said fiber center, and a plurality of wires spirally arranged to the left around said plurality of fibers and wherein said hybrid rope is twisted to the right so that said hybrid rope resists rotating when a tension force is applied to the rope in a lifting operation.

14. The hybrid rope of claim 13 wherein said jacket is made of one of polypropylene, thermoplastic polyurethane, high-density polyethylene, linear low-density polyethylene, or nylon.

15. The hybrid rope of claim 13 wherein said plurality of fibers is spirally arranged with a helical angle of approximately 12.5 degrees.

16. The hybrid rope of claim 13 wherein said plurality of fibers is one of aramid fibers, liquid-crystal polymer fibers, ultra high molecular weight polyethylene fibers, poly(p-phenylene-2,6-benzobisoxazole) fibers, or high modulus fibers.

17. The hybrid rope of claim 13 wherein said plurality of fibers is seven.

18. The hybrid rope of claim 13 wherein said plurality of strands is four.

19. The hybrid rope of claim 13 further comprising a lubricant applied to said fiber center prior to said fiber center being jacketed.

20. The hybrid rope of claim 13 wherein said hybrid rope is compacted by a swaging or roller die compaction process.

* * * * *